United States Patent [19]

Kohyama et al.

[11] Patent Number: 4,607,934

[45] Date of Patent: Aug. 26, 1986

[54] ELECTROPHOTOGRAPHY USING A PHOTOSENSITIVE DRUM WITH MULTI-PHOTOSENSITIVE LAYERS SENSITIVE TO DIFFERENT WAVE LENGTHS

[75] Inventors: Mitsuaki Kohyama, Tokyo; Toshihiro Kasai, Yokohama; Haruhiko Ishida, Tokyo, all of Japan

[73] Assignee: Kabushiki Kaisha Toshiba, Kawasaki, Japan

[21] Appl. No.: 625,790

[22] Filed: Jun. 28, 1984

[30] Foreign Application Priority Data

Jul. 5, 1983 [JP] Japan ..... 58-121777

[51] Int. Cl.[4] ..... G03G 21/00

[52] U.S. Cl. ..... 355/3 R; 355/3 CH; 355/14 E; 430/31

[58] Field of Search ..... 355/3 R, 3 PP, 67, 70, 355/71, 14 E, 3 CH; 430/57, 31; 361/212, 220

[56] References Cited

U.S. PATENT DOCUMENTS 4,035,750 7/1977 Staudenmayer et al. ..... 355/3 R
4,170,413 10/1979 Bayer ..... 355/3 R
4,392,737 7/1983 Nishikawa .

FOREIGN PATENT DOCUMENTS 2726805 12/1978 Fed. Rep. of Germany .
53-148444 12/1978 Japan .
56-24383 3/1981 Japan ..... 355/3 R
56-151941 11/1981 Japan .
57-8183 5/1982 Japan .

OTHER PUBLICATIONS

A. R. Meinyk, J. S. Berkes and L. B. Schein, "A Layered Se-Te Photoreceptor for a GaAlAs Laser Printer", 1981, pp. 1-8.
Japan Abstracts Japanese Patent 58-49982.
Japan Abstracts Japanese Patent 58-14877.

*Primary Examiner*—Arthur T. Grimley
*Assistant Examiner*—J. Pendegrass
*Attorney, Agent, or Firm*—Cushman, Darby & Cushman

[57] ABSTRACT

An electrophotographic device is provided with a photosensitive drum having a plurality of photosensitive layers which are different from one another in spectral sensitivity. First and second uniform exposure devices are arranged at different positions about the photosensitive drum. Each of the first and second uniform exposure devices includes a plurality of single color light sources. The light sources of the first exposure device have a different color than the light sources of the second exposure device. The colors correspond to the spectral sensitivity of each of the photosensitive layers, and are used as the uniform exposure light source for the photosensitive drum.

12 Claims, 17 Drawing Figures

ELECTROPHOTOGRAPHY USING A PHOTOSENSITIVE DRUM WITH MULTI-PHOTOSENSITIVE LAYERS SENSITIVE TO DIFFERENT WAVE LENGTHS

BACKGROUND OF THE INVENTION

The present invention relates to an electrophotographic device such as the laser printer and, more particularly, it relates to an electrophotographic device provided with a photosensitive body which has multi-photosensitive layers.

Generally, with respect to electrophotographics, a copy is obtained by uniformly charging a photosensitive body and then image-exposing it to form an electrostatic latent image. The electrostatic latent image is developed by charged particles (or developer) and the developed image is transferred onto material such as a sheet of paper. Then the transferred image is fixed on the transferring material by heating. In the case of this type electrophotographic device, the stability of the photosensitive body, which is used repeatedly, is important.

In this application, the primary component of stability is the stability of photoconductivity. The stability of images depends particularly upon how stable the electrostatic properties (e.g., charge potential and residual potential after irradiation) are when the photosensitive body is used continuously or with intervals.

The photosensitive body is usually subject to uniform exposure before it is charged to make the image stable. This procedure provides preparatory fatigue to the photosensitive body and eliminates any charge left when it is used repeatedly. This uniform exposure is performed with a device called either pre-exposure lamp, erasing lamp or pre-fatigue lamp. When the properties of the photosensitive body are stabilized by this uniform exposure, particular consideration must be paid particularly to those photosensitive bodies which are easily fatigued.

A manner of stabilizing the fatigue of an arsenic/-selenium photosensitive body, for example, is disclosed in the Japanese Patent Disclosure No. Sho-53/148444. This document teaches that the initial variation of charge potential when the photosensitive body is used repeatedly may be held small by radiating the photosensitive body with light having a specific wavelength (a specific color), for the purpose, in particular, of strongly pre-fatiguing the photosensitive body prior to charging. A first green lamp and a second red lamp are provided to meet this purpose. In the copying mode, both the first and second lamps are turned on in the beginning and only the first lamp is kept on thereafter. The properties of the photosensitive body are stabilized by controlling the first and second lamps in this manner. In this case, the first green light is used for erasing the residual charges on the photosensitive body while the second red light is used just before the formation of the copy. The red light includes a wavelength of 620 nm by which the photosensitive body tends to be fatigued. Thus the first green light eliminates charge while the second red light provides pre-fatigue.

The stabilization of charge potential is also enhanced by gradually reducing the strengths of these uniform exposure lamps from the beginning of copying cycle.

The above-described manner of stabilizing the electrostatic properties of the photosensitive body has not reached such level yet that it can meet any change of environmental conditions such as temperature and humidity. It is suitable, however, in practical applications.

A selenium or silicon type photosensitive body is thought desirable which is sensitive to near infrared rays in the vicinity of 800 nm which is the wavelength of semiconductor lasers. An example of the selenium type is a Se/SeTe/Se/Al-based sensitive body and a Si-H-C/Si-H-Ge/Si-H-B/Al-based one is representative of the silicon type. Each has a multi-layer construction in which each layer is different from one another in spectral sensitivity. The reason why the photosensitive body has this multi-layer construction is, for example, that selenium/tellurium alloy is excellent in its sensitivity relative to the near infrared rays but abnormally quick in the dark decay of its charge. In order to cover the abnormal quickness of its dark decay, therefore, a layer of amorphous selenium (Se) or a layer made by adding a little amount of tellurium, antimony or arsenic is coated on it. Also in the case of amorphous silicon photosensitive body, its construction is often of multi-layer type for the same reason.

It was reported by A. R. Melnyk and others in "A Layered Se-Te Photoreceptor For A GeA As Laser Printer" at the "First International Congress On Advance In Non-Impact Printing Technologies" held by SPSE in June, 1981 that property deterioration of those photosensitive bodies which are sensitive to long wavelengths could be prevented by this multilayer construction. A method of manufacturing photosensitive bodies having superposed layers of Se-Te and Se-Te-Sb on a conductive support is disclosed in the Japanese Patent Disclosure No. Sho-56/151941.

Further, the amorphous silicon photosensitive body whose sensitivity relative to long wavelength has been increased by germanium is described in detail in the Japanese Patent Disclosure No. Sho-57/78183, for example.

Photosensitive bodies which had fundamentally the same construction have been manufactured on a trial basis. As the result, it has been found that their sensitivity relative to long wavelength can be enhanced, but that their electrostatic properties become extremely more unsatisfactory as compared with the conventional photosensitive bodies because of increase of persistent residual potential during continuous use and because of large reduction of charge acceptance when heated to a high temperature. These drawbacks are difficult to solve to meet practical purposes, and the electrophotographic devices using the photosensitive bodies of this type have not been practiced yet or have been provided as samples which can be used only under limited conditions.

SUMMARY OF THE INVENTION

The present invention is therefore intended to eliminate the above-mentioned drawbacks, for example, reduction of charge potential, increase of residual potential when being used continuously, and large reduction of charge at high temperatures. Thus the present invention is an electrophotographic device capable of stabilizing the properties of a photosensitive body.

In the present invention an electrophotographic sensitive body has a plurality of photosensitive layers which are different from one another in spectral sensitivity. A uniform exposure means, in which a plurality of single color light sources each having a different color corresponding to the spectral sensitivity of each of the photosensitive layers, is used as the uniform exposure light source for the electrophotographic sensitive body. The exposure means is arranged facing each of the different positions of the electrophotographic sensitive body.

BRIEF DESCRIPTION OF THE DRAWINGS

These and other objects and advantages of the present invention will become apparent and more readily appreciated in the following detailed description of the presently preferred embodiments, taken in conjunction with the accompanying drawings, of which.

DETAILED DESCRIPTION OF THE PREFERRED EMBODIMENTS

One embodiment of the electrophotographic device according to the present invention will be described in detail referring to FIGS. 1 through 7B.

Figure 1:
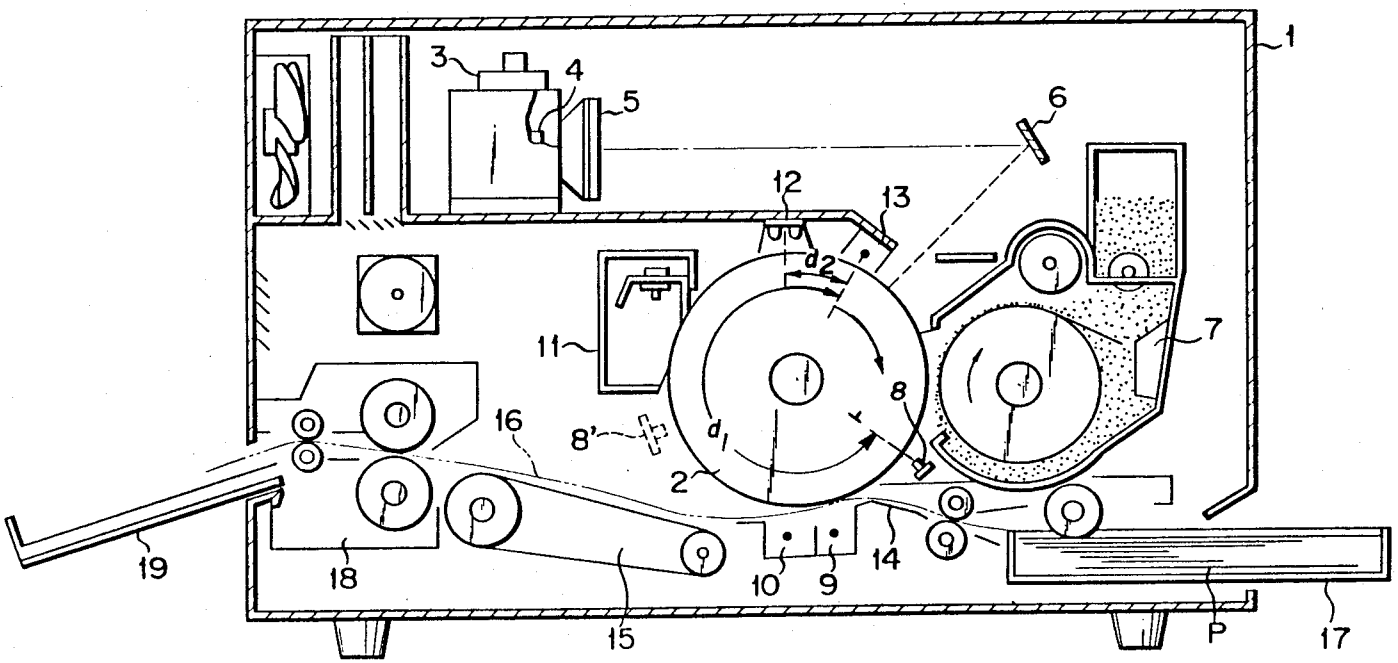
FIG. 1 is a sectional view schematically showing a laser printer as the electrophotographic device of one embodiment of the present invention.

FIG. 1 shows a laser printer which serves as the electrophotographic device. In FIG. 1, numeral 1 represents a body of the laser printer. A photosensitive drum 2 which serves as the electrophotographic sensitive body is supported, rotatable in the clockwise direction, substantially in the center of body 1. An image exposing unit 3 is arranged at the upper portion in body 1. This image exposing unit 3 includes a laser beam source (not shown), rotatable polygonal mirror 4, imaging lens 5, mirror 6 and the like. The laser beam, modulated according to image information, is radiated on photosensitive drum 2. Arranged around photosensitive drum 2 along its rotating direction (or clockwise direction) are a developing unit 7, first uniform exposing unit ("first exposure means") 8, transferring corona charger 9, peeling-off corona charger 10, blade cleaner 11, second uniform exposing unit ("second exposure means") 12 and electrifying corona charger 13.

A conveying path 16 for transfer papers P, which includes a guide 14, conveying belt 15 and the like is provided at the lower portion in body 1. Transfer paper P, fed from a paper supply cassette 17, is conveyed between photosensitive drum 2 and transferring charger 9, between photosensitive drum 2 and peeling-off charger 10, and then through a fixing heat roller unit 18 to a paper discharge tray 19.

Figure 2:
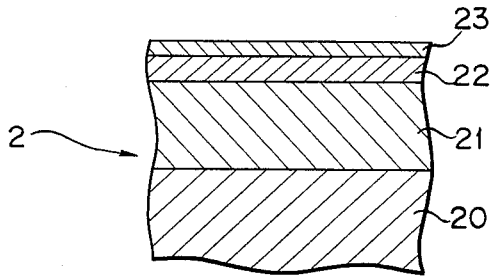
FIG. 2 is a sectional view showing a part of the photosensitive drum of FIG. 1.
Figure 3:
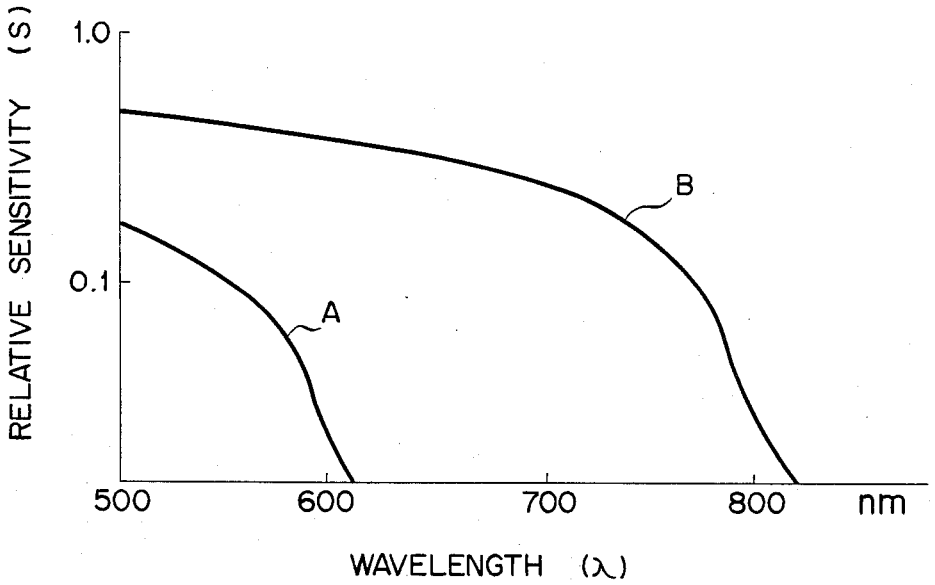
FIG. 3 is a chart showing the relative spectral sensitivities of each layer of the photosensitive body.

Photosensitive drum 2 is of selenium type having SeTeSb/SeTe/Se/Al-based multi-layers. As shown in FIG. 2, photosensitive drum 2 comprises a cylindrical aluminium base 20, an amorphous selenium layer (about 50 μm thick) 21 coated on base 20, a selenium-tellurium alloy layer (2 μm thick and the concentration of tellurium is about 40%) 22 coated on amorphous selenium layer 21, and a selenium-tellurium-antimony layer (about 2 μm thick) 23 coated on selenium-tellurium alloy layer 22. The relative spectral sensitivity S of each of these layers is as shown in FIG. 3. Selenium-tellurium layer 22 has a higher sensitivity (curve B) which extends to a longer wavelength than that of the selenium-tellurium-antimony layer 23 (curve A).

Charger 13 faces photosensitive drum 2, and charges the drum. First exposing unit 8 is located at a position separated by a first predetermined distance $d_1$ (measured as an angular displacement in the direction opposite that which the drum 2 is rotated) from the portion of the photosensitive layers 21–23 opposing charger 13. Second exposing unit 12 is located at a position separated by a second predetermined distance $d_2$ (measured as an angular displacement in the direction opposite that which drum 2 is rotated) from the portion of the photosensitive layers 21–23 facing charger 13.

Figure 4:
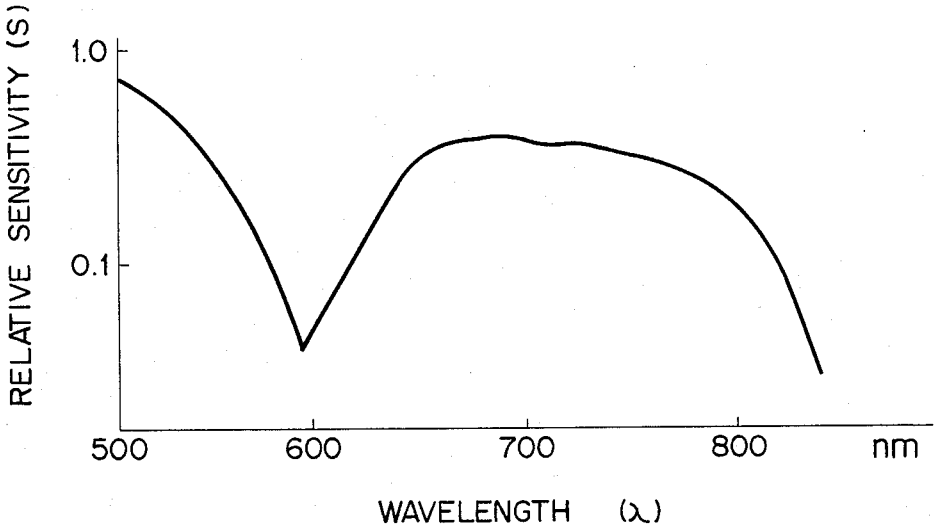
FIG. 4 is a chart showing the total relative spectral sensitivity.

The total spectral sensitivity S of photosensitive drum 2 obtained by superposing these layers 21, 22 and 23 upon each other is as shown in FIG. 4. As is apparent from FIG. 4, deterioration of sensitivity occurs in the vicinity of a wavelength of 600 nm, since light in the vicinity of this wavelength is absorbed by surface layer 23 of selenium-tellurium-antimony, but without generation of carriers for contributing photoconductivity. In addition, practically no light reaches selenium layer 21. Therefore, selenium layer 21 does not contribute to the sensitivity directly; but light is absorbed by both selenium-tellurium-antimony (Se-Te-Sb) layer 23 and selenium-tellurium (Se-Te) layer 22, which serve as layers for generating carriers. Accordingly, it is selenium-tellurium-antimony (Se-Te-Sb) and selenium-tellurium (Se-Te) layers 23 and 22 of these three photosensitive layers that contribute to photoconductivity. Se layer 21 works as a charge transport layer.

Photosensitive drum 2 is light-irradiated by second uniform exposing means 12, rotating at a peripheral speed of 180 mm per second in the clockwise direction, and then uniformly electrified by electrifying corona charger 13 to have a surface potential of about 600 V. The laser beam, modulated by an image signal, is horizontally scanned by rotatable polygonal mirror 4 and radiated, as a light beam of about 780 nm, onto the uniformly charged photosensitive drum 2 through imaging lens 5. A desired electrostatic latent image is thus formed on photosensitive drum 2.

The electrostatic latent image on photosensitive drum 2 is then developed with toner as a visible image through the well-known magnetic brush developing unit 7. Photosensitive drum 2, on which the toner (or visible) image has been formed, is light-radiated by first uniform exposing unit 8 to erase the latent image. Thereafter, transfer paper P is fed between photosensitive drum 2 and transferring corona charger 9 in close contact with photosensitive drum 2.

Charge having a polarity opposite to that of the visible image on photosensitive drum 2 is applied from transferring corona charger 9 to transfer paper P to transfer the toner image on photosensitive drum 2 to transfer paper P. An AC voltage of about 400 Hz is then applied by peeling off corona charger 10 to discharge charged paper P, thereby enabling transfer paper P to be peeled off from photosensitive drum 2. Transfer paper P thus peeled off is fed to fixing heat roller unit 18 by conveying belt 15 to fix the toner image onto transfer paper P. Thereafter, transfer paper P is discharged into paper discharge tray 19, thereby completing one cycle of the copying operation.

Any toner left on photosensitive drum 2 after the toner transfer operation is scraped off by blade cleaner 11. This cleaning operation is finished after repeating it a desired number of copy times under electrical control.

Figure 5A:
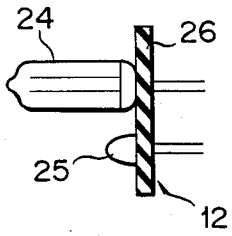
FIGS. 5A and 5B are sectional views showing a second uniform exposure device according to the first embodiment.
Figure 5B:
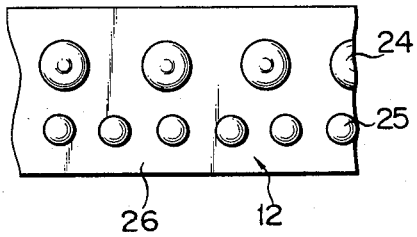
Figure 6A:
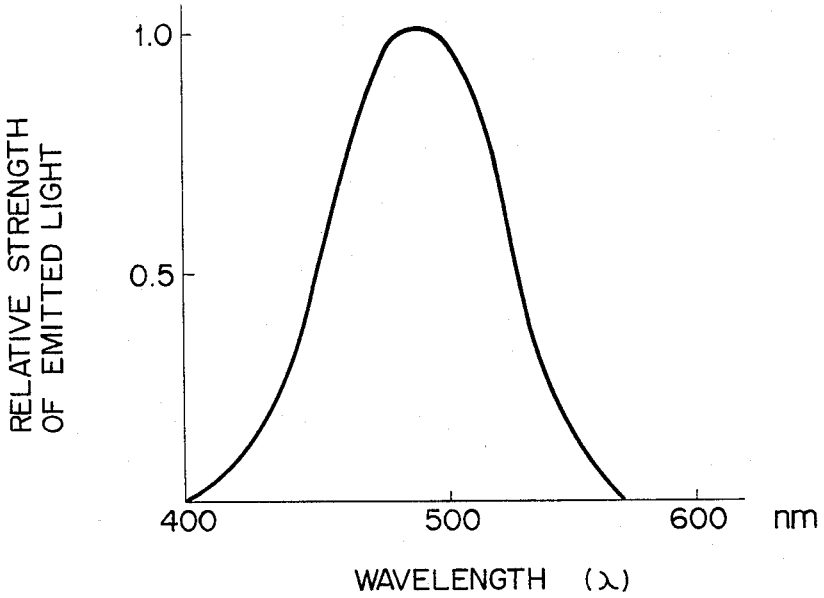
FIGS. 6A and 6B are charts showing spectroradiation characteristics of a fluorescent green glow lamp and LED, respectively.
Figure 6B:
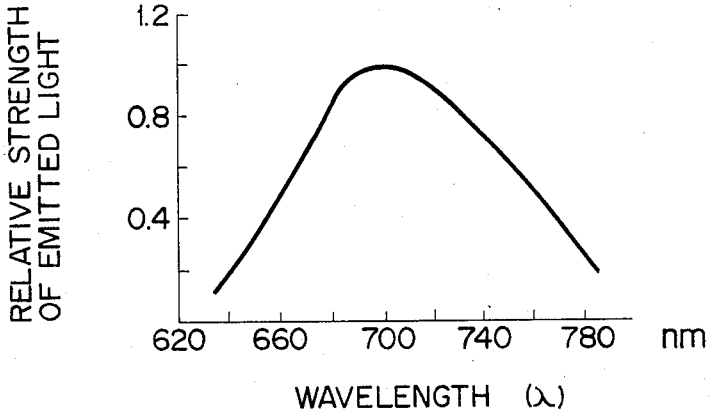

Second uniform exposure unit 12 includes an integral arrangement of single color light sources, as shown in FIGS. 5A and 5B, and is located opposite to photosensitive drum 2 of the selenium type. Exposure unit 12 is to be distinguished from the conventional exposure unit which employed white light sources or a single color light source such as green or blue. Exposure unit 12 includes, for example, a plurality of blue fluorescent glow lamps (NL-22/B made by ELBAM) 24 each having a spectral radiation distribution as shown in FIG. 6A, and a plurality of LEDs (TLR 101 made by Toshiba) 25 each having a spectroradiation distribution as shown in FIG. 6B. Glow lamps 24 and LEDs are arranged on the same base plate 26. As already shown in FIG. 3, each of lamps 24 and 25 has a wavelength which makes only one of the photosensitive layers 22 and 23 sensitive.

The following tests were done under the arrangement as described above:

(1) Environmental temperature conditions: 10° C., 25° C., 40° C.

(2) Light sources for the second uniform exposure unit:

(a) Tungsten lamps (white) turned on.

(b) Fluorescent glow lamps (blue) 24 and LEDs (red) 25 turned on at the same time.

(c) Only the fluorescent glow lamps 24 turned on.

(d) Only the LEDs 25 turned on.

(3) Amount of light radiated for uniform exposure: 60 erg/cm2

(4) Matters measured:

(a) Change of charge potential.

(b) Change of residual potential (after radiation of the laser beam at 40 erg/cm2).

(c) Change of the both potentials after continuous copying operation of 100 cycles.

Since a total of twelve different conditions were tested, citation of measured data is omitted, but can be summarized as follows:

(a) With the tungsten lamps, the charge potential lowers more than 200 V at 40° C. after continuous copying operation of 100 cycles. No significant change can be found at 10° C. and 25° C. The residual potential increased by 30 V–50 V at 40° C.

(b) With fluorescent glow lamps 24 and LEDs 25 turned on at the same time, a trend similar to that with the tungsten lamps can be found.

(c) With only fluorescent flow lamps 24 turned on, the residual potential increases by 80 V–100 V both at 10° C. and 25° C., but the fall of the charge potential at 40° C. is less than 100 V.

(d) With only LEDs 25 turned on, the charge potential falls by 150 V–200 V at 40° C., but the increase of the residual potential at 10° C. and 25° C. was small, about 50 V.

To minimize the change of both charge and residual potentials over the temperature range of from 10° C. to 40° C., the conventional selection of wavelength and strength of the uniform exposure lamps is not efficient and that changeover of wavelength radiated is effected.

More specifically, the above-cited results show that the characteristics of the photosensitive layers depend upon temperature and wavelength radiated. As a result, studies were conducted concerning what factors contribute most to the characteristics of the photosensitive layers, and as the result, the following new measures were discovered:

(1) Se-Te layer 22 is further influenced by light radiation and takes a longer time to restore its condition than Se-Te-Sb layer 23. Therefore, the position of radiating light relative to Se-Te layer 22 is to be separated as far as possible from the charging position in the direction in which photosensitive drum 2 is rotated.

(2) Since Se-Te-Sb layer 23 is less influenced by light radiation, light which acts on Se-Te-Sb layer 23 only is employed to make exposure before the charging process.

Figure 7A:
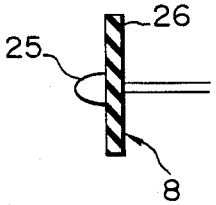
FIGS. 7A and 7B are sectional and front views showing the first uniform exposure device according to the first embodiment.
Figure 7B:
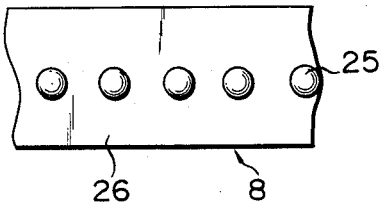

Accordingly, only blue fluorescent glow lamps 24 of second uniform exposure unit 12 are turned on at first. Also, first uniform exposure unit 8 includes only plural red LEDs 25 as shown in FIGS. 7A and 7B. The amount of radiation of second uniform exposure unit 12 is set at 40 erg/cm2 and that of first uniform exposure unit 8 is set at 50 erg/cm2.

The test was done again with wavelengths of light radiated onto photosensitive layers 22 and 23 divided so as not to influence each of the photosensitive layers, which is an important feature of this invention. Test results show that both of the charge and the residual potential change over the temperature range is less than 100 V and 50 V, respectively. According to these measures, when photosensitive drum 2 has the multi-layer construction, light radiation relative to the photosensitive layer which is easily fatigued should be separated from the charging position and light which is used just before the charging process should act on the photosensitive layer which is fatigued only with difficulty, which is an important feature of this invention.

Although first exposure unit 8, which serves as the exposure lamp before the transferring process, is used to make it easy to peel off transfer paper P from photosensitive drum 2, also and to improve transfer of developed image, it is not necessarily needed when transfer paper P is mechanically peeled from photosensitive drum 2. In this case, trapped charge of the Se-Te layer cannot be removed only by blue light 24. When first uniform exposure unit 8' is located as shown by a broken line in FIG. 1, therefore, photosensitive drum 2 is less stabilized, but an extreme improvement can be achieved as compared with the conventional case. When first uniform exposure unit 8' is located as shown by the broken line in FIG. 1, cleaning ability can be improved secondarily because removal of charge is carried out before cleaner 11. Accordingly, this position shown by the broken line in FIG. 1 is a preferable one as long as fatigue of photosensitive drum 2 is allowable.

As described above, photosensitive drum 2 has plural photosensitive layers 22 and 23 which are different in spectral sensitivity. Second uniform exposure unit 12 has a plurality of single color light sources 24 and 25 which correspond to the spectral sensitivity of each of the photosensitive layers 22 and 23 and which are distributed over the periphery of the photosensitive drum 2. As a result, stable use of this type of photosensitive drum 2, which has a large fluctuation in fatigue, can be realized.

A variation of the photosensitive drum in which amorphous silicon is employed as a photosensitive layer will be described.

Figure 8:
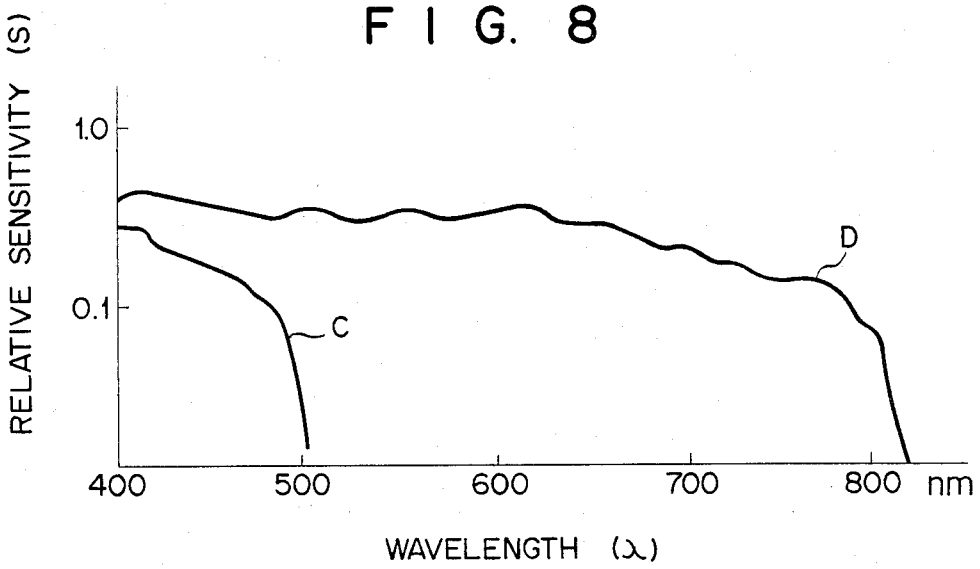
FIG. 8 is a chart showing the spectral sensitivities of a photosensitive body in which amorphous silicon is employed, in a second embodiment according to the present invention.
Figure 9:
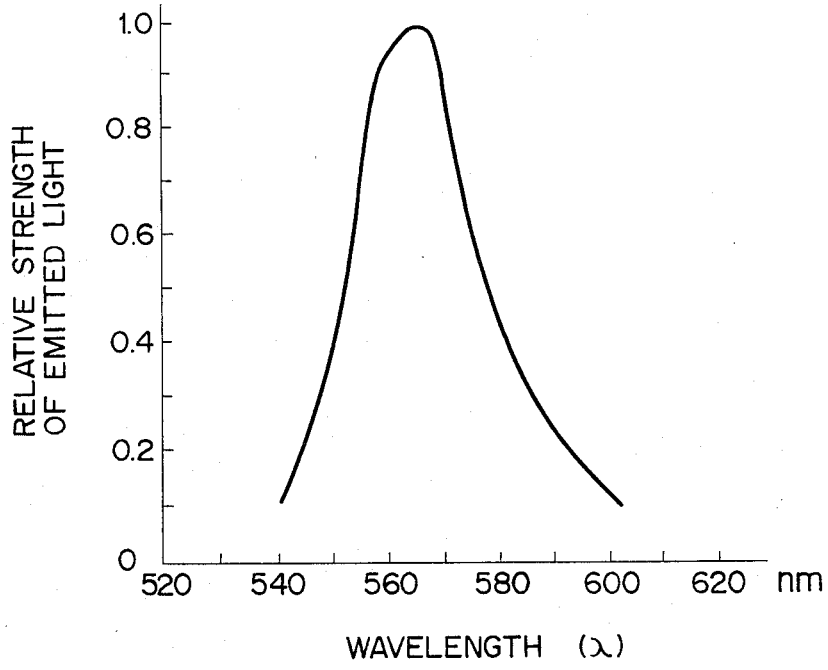
FIG. 9 is a chart showing the spectroradiation characteristic of an LED.

The spectral sensitivity of a Si-H-C layer which serves as the outermost layer of this photosensitive drum is represented by a curve C in FIG. 8 and that of a next Si-H-Ge layer by a curve D in FIG. 8. The spectral sensitivity of all photosensitive layers of the photosensitive drum has a curve substantially similar to curve D. With this photosensitive drum, dark decay tends to become quick particularly at higher temperatures and as a result, the charge potential is likely to fall. As a countermeasure, an elimination lamp may be used which comprises a mixture of fluorescent glow lamps 24 to each of which a blue filter is attached to emit a light less than 500 nm, and of the LEDs (TLG 102 made by Toshiba) each having the characteristic shown in FIG. 9. Stability is achieved by activating only the blue color light with temperatures higher than 35° C. and activating both of the lights at temperatures lower than 35° C.

Figure 10A:
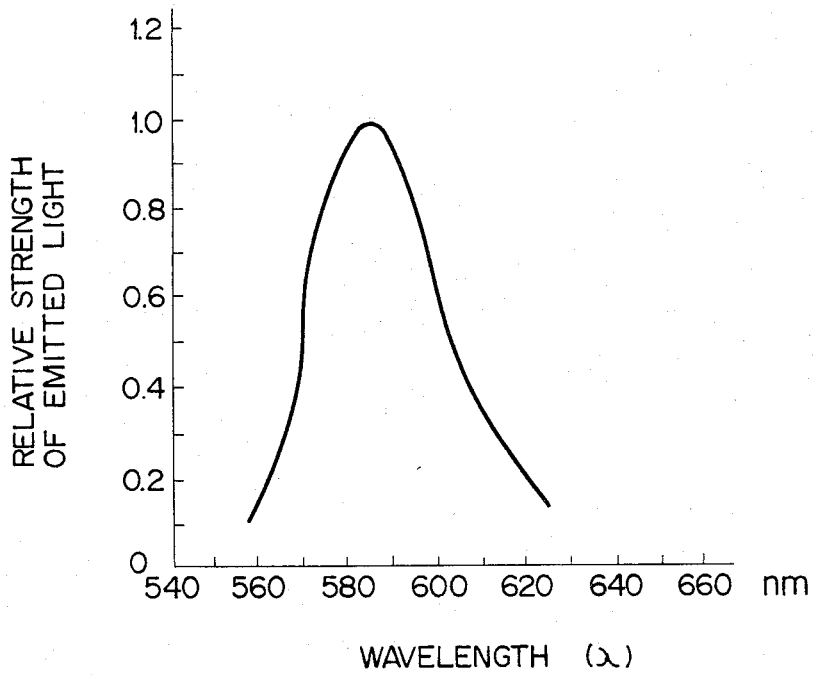
FIGS. 10A through 10C are charts showing the spectroradiation characteristics of another LED.
Figure 10B:
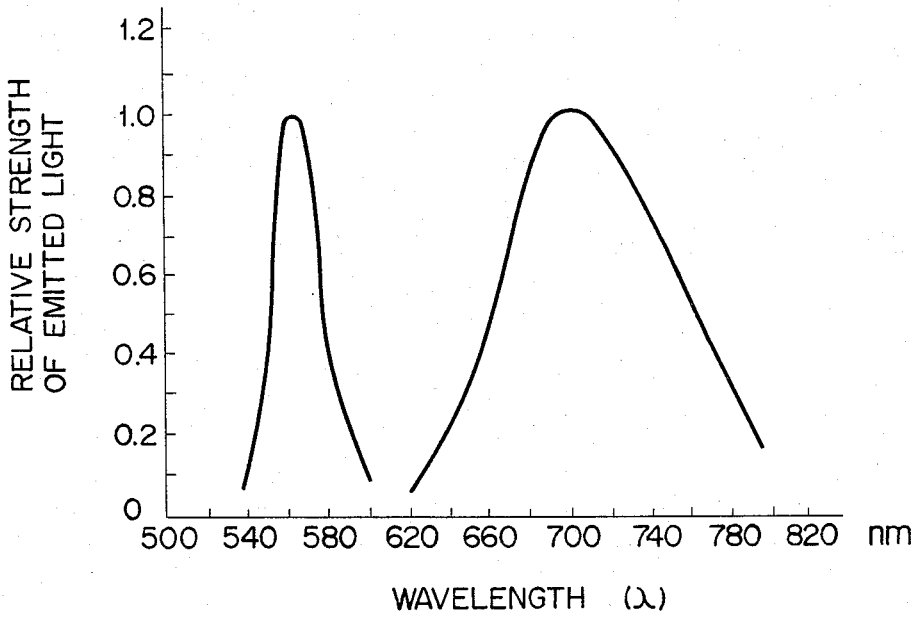
Figure 10C:
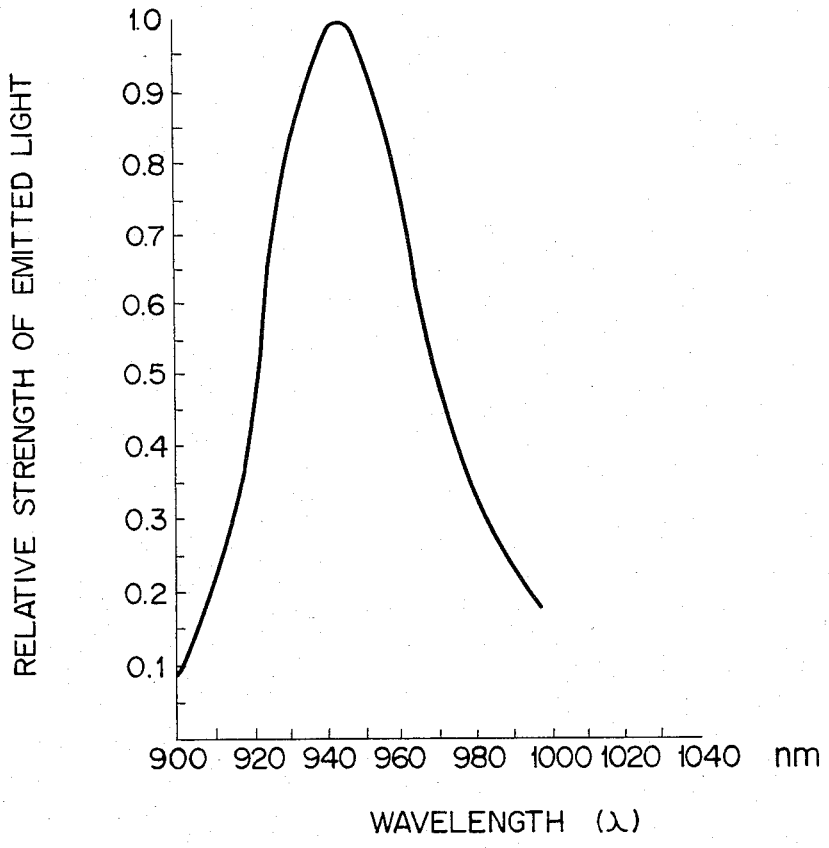
Figure 11A:
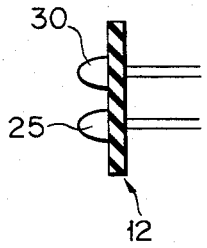
FIGS. 11A and 11B are sectional and front views showing the second uniform exposure device in the second embodiment according to the present invention.
Figure 11B:
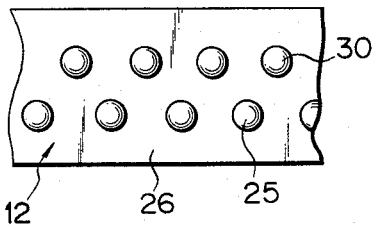

Characteristics are shown in FIGS. 10A to 10C relating to other LED light sources for radiating single color light which can correspond to other photosensitive drums. FIG. 10A shows the characteristic of the TLG 102 made by Toshiba, FIG. 10B that of a TLRG 101 made by Toshiba, and FIG. 10C that of a TLN 103 made by Toshiba. Red and green LEDs are unified in the case of the light source shown in FIG. 10B. The single color light used here does not represent only a single wavelength, but means a light distributed only at a specific wavelength area. In addition to the lights mentioned above, various kinds of single color lights can be obtained by combining optical filters with a white light source. When combined like this, it is possible to correspond to any other photosensitive drums of multi-layer type imagined. FIG. 11 shows a concrete example of the light source which is a combination of green LED (TLG 102) 25 and red LED (TLR 101) 30.

The photosensitive drum of the multi-layer type can be stabilized when it is arranged to have a relatively simpler construction as described above. Further, the wavelength and actuating mode of a single color light has no particular limitation. Furthermore, the number of the single color lights is not limited to two but should be changed depending upon the construction and characteristics of a photosensitive drum.

What is claimed is:

1. An electrophotographic device comprising:

a photosensitive body movable in a path along a first direction and provided with plural photosensitive layers having different spectral sensitivities;

exposure means, arranged facing said photosensitive body, for exposing said photosensitive body as it moves, said exposure means including a plurality of exposure units having spectro-radiation characteristics which correspond to the spectral sensitivity of said photosensitive layers, respectively, said exposure units being located at different positions along said path and facing said photosensitive body, said exposure units including a first exposure means and a second exposure means, said second exposure means for producing an emission in a second range of wavelengths, said first exposure means for producing an emission having a first range of wavelengths generally longer than said second range of wavelengths produced by said second exposure means; and charging means arranged facing said photosensitive body for charging said body, wherein:

said first exposure means is located at a position separated by a first predetermined distance from that portion of said photosensitive layers which the charging means is facing, in a direction opposite said first direction, and said second exposure means is located at a position separated by a second predetermined distance, shorter than said first predetermined distance, from that portion of said photosensitive layers which said charging means is facing, in the direction opposite said first direction.

2. The electrophotographic device according to claim 1, wherein said first exposure means has a single color light source of red, and said second exposure device a single color light source of blue.

3. The electrophotographic device according to claim 1, wherein said second exposure means is arranged adjacent to said charging means.

4. The electrophotographic device according to claim 1, wherein said photosensitive body is formed as a drum and supported to rotate in a predetermined direction generally corresponding to said first direction.

5. The electrophotographic device according to claim 1, further comprising:

transferring means for transferring a visible image formed on said photosensitive layers onto a transfer paper, said transferring means being separated by a predetermined distance from said first exposure means in said predetermined rotating direction of said photosensitive body.

6. The electrophotographic device according to claim 5, wherein said transferring means is arranged adjacent to said first exposure means.

7. The electrophotographic device according to claim 1, further comprising:

cleaner means, arranged between said first and said second exposure means, for removing the visible image left on said photosensitive layer.

8. The electrophotographic device according to claim 7, wherein said first exposure means is arranged adjacent to said cleaner means.

9. An electrophotographic device as in claim 1 wherein said first and second predetermined distances correspond to the lapse of time required for said corresponding layers to recover from fatigue.

10. A method of producing an image on a medium comprising the steps of:

(1) rotating a cylindrical photosensitive drum in a predetermined direction;

(2) irradiating an area of the cylindrical surface of said rotating drum with a first predetermined range of wavelengths of light, said first predetermined range of wavelengths activating a first wavelength-selective photosensitive layer disposed on and covering said surface;

(3) thereafter applying an electrical charge to said area of said surface irradiated by said irradiating step (2);

(4) thereafter (a) forming a latent electrostatic image on said area, (b) developing said latent image with developing agent, and (c) transferring said developed image to a medium;

(5) after said developing step (b), irradiating said area with a second predetermined range of wavelengths of light different from said first range, said second range activating a second wavelength-selective photosensitive layer also disposed on and covering said surface;

(6) cleaning excess developing agent from said area;

(7) waiting at least a predetermined period of time after said irradiating step (5) is performed; and (8) thereafter repeating said steps (2)–(6).

11. A method as in claim 10 wherein said waiting step (7) comprises the step of rotating said drum a predetermined angular displacement in said predetermined direction.

12. A photocopying apparatus including:

a cylindrical photosensitive drum rotatable in a first direction of rotation, said drum having deposited on an outer surface thereof at least first and second photosensitive layers, said first layer being activated by a first wavelength $\lambda_1$ of radiant energy, said second layer being activated by a second wavelength $\lambda_2$ of radiant energy different from said first wavelength $\lambda_1$;

charging means for applying an electrical charge to the portion of said first and second layers rotating through a first predetermined region of space;

first exposing means for irradiating the portion of said first and second layers rotating through a second predetermined region of space, angularly displaced from said first region in a second direction opposite said first direction of rotation by a first predetermined angular displacement, with radiant energy of said first wavelength $\lambda_1$; and second exposing means for irradiating the portion of said first and second layers rotating through a third predetermined region of space different from said second region with radiant energy of said second wavelength $\lambda_2$, said third region angularly displaced from said first region in said second direction by a second predetermined angular displacement less than said first angular displacement.

* * * * *